US005150479A

United States Patent [19]

Oleson

[11] Patent Number: 5,150,479

[45] Date of Patent: Sep. 29, 1992

[54] PROTECTIVE HELMET

[75] Inventor: Richard A. Oleson, Lexington, Ky.

[73] Assignee: E. D. Bullard Company, Sausalito, Calif.

[21] Appl. No.: 763,619

[22] Filed: Sep. 23, 1991

[51] Int. Cl.[5] ..... A42B 3/00

[52] U.S. Cl. ..... 2/414; 2/416; 2/5

[58] Field of Search ..... 2/416, 414, 411, 412, 2/425, 410, 417, 418, 419, 420, 5, 6

[56] References Cited

U.S. PATENT DOCUMENTS

| | | | |
|---|---|---|---|
| 4,106,127 | 8/1978 | Marangoni | 2/416 |
| 4,286,339 | 9/1981 | Coombs | 2/414 |
| 4,932,076 | 6/1990 | Giorgio et al. | 2/5 |
| 5,044,016 | 9/1991 | Coombs | 2/416 X |

*Primary Examiner*—Peter Nerbun
*Attorney, Agent, or Firm*—Maurice L. Miller, Jr.

[57] ABSTRACT

An improved fireman's helmet is disclosed which includes an outer shell, a compressible, non-resilient foam liner, and an inner shell of hemispherical shape conforming to the foam liner. An annularly extending channel of generally U-shaped cross-section is integrally formed on and around an outer edge portion of the inner liner into which an edge portion of the foam liner is disposed. A series of flexible, stretchable, resilient crossing one another at an apex, extend radially outwardly and downwardly from the apex and extend under and across the channel, thence upwardly between the liner and the outer shell to connections on distal end portions thereof with rigid, non-resilient, incompressible anchors resting on a floor of the channel. The anchors are disposed within open slots formed in and around outer surface portions of the liner. Apex impact forces applied to the helmet thus tend to be essentially entirely absorbed without causing deformation of the non-resilient foam liner at the anchor locations, at least within the design limits of the helmet.

14 Claims, 3 Drawing Sheets

PROTECTIVE HELMET

BACKGROUND OF THE INVENTION

This invention relates generally to improved helmets or head gear and more specifically to fire helmets having the capability of absorbing both apex and lateral impact forces such as might be encountered during fire fighting activities.

Generally speaking, such fire helmets have long been known and used in the prior art. See for example U.S. Pat. No. 4,286,339 issued to P. A. Coombs on Sep. 1, 1981 which shows a fireman's helmet having an outer shell, a non-resilient foam liner and a plastic rim into which the liner is molded. A series of headstraps crossing one another at an apex on top of the wearer's head extend radially outward and downward under and across the base of the rim, thence upwardly between the foam liner and the outer shell to loop around a resilient tube which is inset in an outwardly opening slot extending around and within an outer surface portion of the foam liner.

Apex impact forces occurring on the reference helmet tend to be distributed and absorbed as the helmet is forced downwardly toward the head of the wearer thus tending to stretch the headstraps, flatten the resilient tube, and deform the compressible, non-resilient liner which supports the tube. Such deformation of the non-resilient foam liner resulting from distribution of the apex impact forces on the reference helmet is a serious disadvantage since a principle purpose of the liner is to absorb lateral impact forces occurring at the sides of the helmet away from the apex.

By means of the present invention, a suspension system for a foam lined fire helmet is provided which substantially overcomes this and other difficulties previously encountered in the prior art.

SUMMARY OF THE INVENTION

It is an object of the present invention to provide an improved protective helmet having the capability of absorbing both apex and lateral impact forces.

It is further object of this invention to provide an improved protective helmet having a non-resilient foam liner which will not be destructively deformed by apex impact forces applied to the helmet at locations other than at the point of impact, at least within the design limits for which the helmet is manufactured.

Briefly, in accordance with the present invention there is provided a protective helmet which includes an outer shell and a compressible foam liner disposed in the outer shell. A rigid inner shell is also provided which is disposed at least partially within the foam liner. An annularly extending channel is provided which is attached to an outer edge portion of the inner shell, an edge portion of the liner being disposed within the channel. A suspension system including a series of flexible, stretchable, resilient straps is also provided. Incompressible, non-resilient means is disposed in the channel between the foam liner and the outer shell for securing distal end portions of the straps thereto such that an apex impact loading force applied to the shell within the design limits of the helmet is absorbed essentially entirely by stretching of the straps without producing deformation of the liner at the location of the strap securing means.

These and other objects, features and advantages of the present invention will become apparent to those skilled in the art from the following detailed description and attached drawings upon which, by way of example, only a preferred embodiment of the present invention is illustrated.

DESCRIPTION OF THE PREFERRED EMBODIMENT

Figure 1:
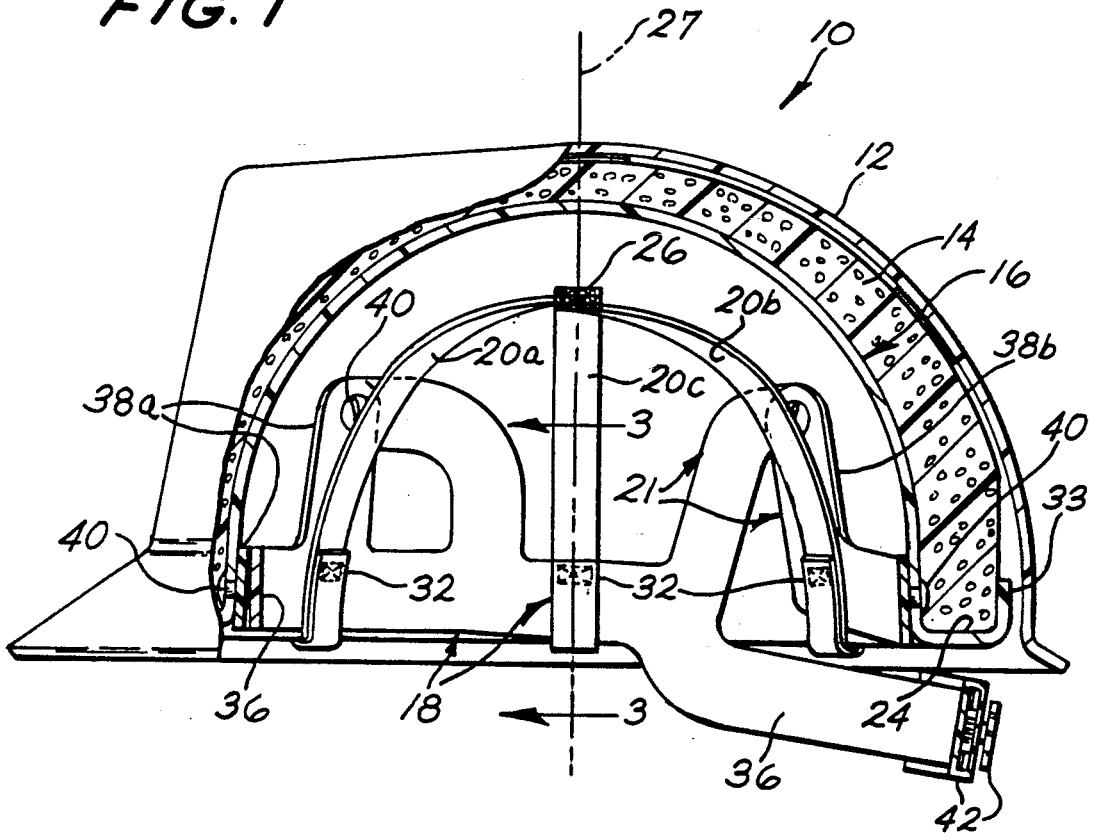
FIG. 1 shows a side elevation view of a fireman's helmet with portions torn away for viewing interior components thereof, thus illustrating a preferred embodiment of my invention.
Figure 2:
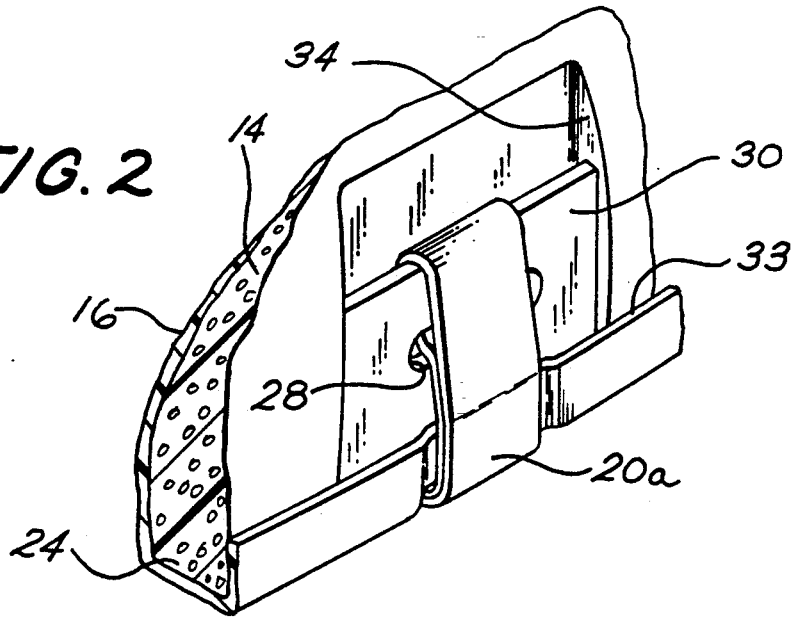
FIG. 2 shows a perspective view of a fragment of the helmet of FIG. 1.

Referring now to the drawing figures there is shown, in a preferred embodiment of my invention, a fireman's helmet 10 having an outer shell 12, a compressible, non-resilient, hemispherically shaped foam liner 14, a rigid hemispherically shaped inner shell 16, and a suspension system 18 having a plurality of flexible straps 20*a, b* and *c* and an adjustable headband assembly 21. Preferably, the outer shell 12 is constructed of a suitable rigid, thermoset or thermoplastic material which may, but need not necessarily, be glass fiber reinforced. The foam liner 14 may be constructed of polyurethane, expanded styrene or other suitable compressible, non-resilient material. The liner 16 may be constructed of any suitable thermoplastic such as ABS, polyphenylene oxide, polycarbonate or the like. The helmet 10 is supported on the wearer's head by means of the suspension system 18, the straps 20*a, b* and *c* of which may be constructed of a flexible, stretchable resilient woven aramid fiber such as sold by du Pont Corporation under the trademark NOMEX, a flexible, stretchable resilient woven nylon fiber or other such suitable material.

The outer surface of the foam liner 14 fits within the conforming interior surface of the outer shell 12 and may, if desired, be removably attached to the latter in any suitable manner such as by means of one or more patches 22 of loop-pile fastening material such as that commonly sold under the trademark VELCRO, although such attachment is optional. The foam liner 14 is shaped to fit flush over the hemispherical surface of the inner shell 16 such that edge portions of the former fit snugly within an annularly extending channel 24 of generally U-shaped cross section integrally formed along and around the outside edge of the inner shell 16.

In the present example, the headstrap system 18 contains three straps 20*a, b* and *c* which cross over one another at an apex 26 (See FIG. 1) on a medial centerline 27 of the helmet 10 where they are joined together as by means of conventional fabric stitching. Each of the straps 20*a, b* and *c* extend downwardly from the apex 26 under and across the headband 21 and the base of channel 24, thence upwardly between the outer shell 12 and the foam liner 14 through an open slot 28 in a slightly arc shaped, generally rectangular anchor 30 of essentially non-compressible, rigid plastic material, thence upward over the upper edge of the anchor 30 and back downwardly along the underside of the corresponding strap to a termination near which the overlapping strap portions are stitched together as at 32 (See particularly FIG. 1). The rigid, non-compressible anchors 30 each rest on edges thereof upon outer peripheral base portion of the channel 24 against a wall 33 and within an outwardly opening slot 34 formed in an outer surface portion of the foam liner 14. The six distal ends of each of the straps 20*a, b* and *c* are thus secured to different ones of six such anchors 30. The anchors 30 of the present example are relatively thin as compared with their lengths and widths and are readably removable from the channel 24, to aid in the removal and replacement of the entire suspension system 18 from the helmet 10 as desired.

Figure 5:
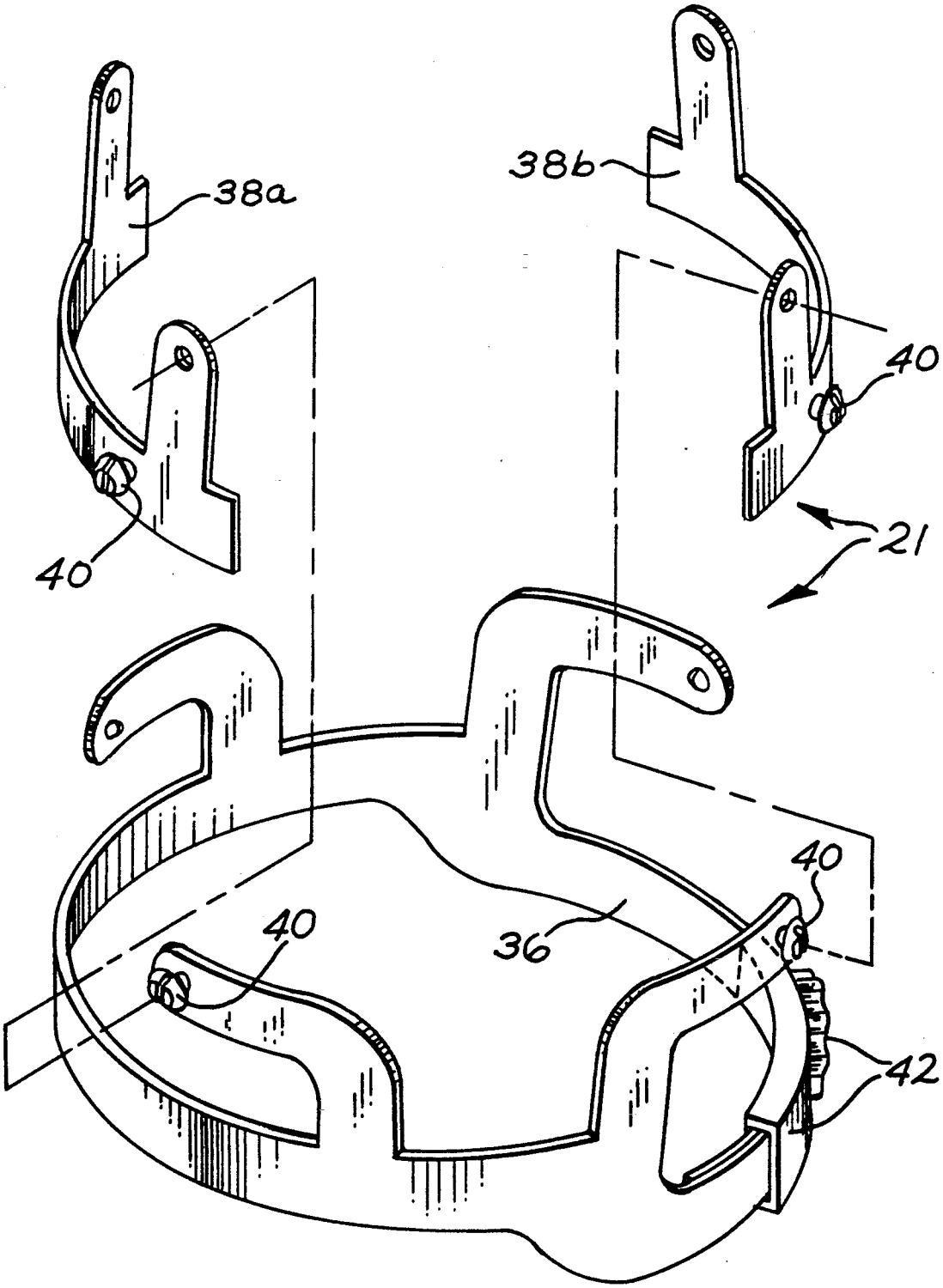
FIG. 5 shows an exploded perspective view of a headband assembly used in the helmet of FIG. 1.

The adjustable headband 21 is shown in FIGS. 1 and 5 and includes an adjustable oval shaped band 36 adapted to encircle the head of the wearer in the usual well known manner, and forward and rearward attachment elements 38*a* and *b* respectively. The attachment elements 38*a* and *b* are removably attached to both the inner liner 16 and the band 36 by means of suitable mechanical fasteners 40. Adjustment of the band 36 is accomplished by means of a ratchet assembly 42 such as that shown and described in my U.S. Pat. No. 4,888,831 issued Dec. 26, 1989, or by other suitable and well known adjusting means.

Figure 3:
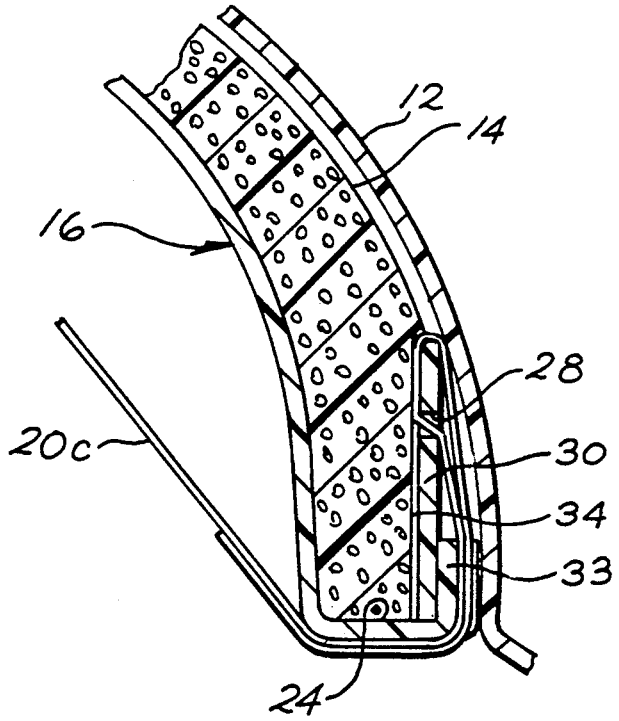
FIG. 3 shows a cross-sectional view of a portion of the helmet of FIG. 1 as viewed along cross-section lines 3—3 of the latter mentioned figure.
Figure 4:
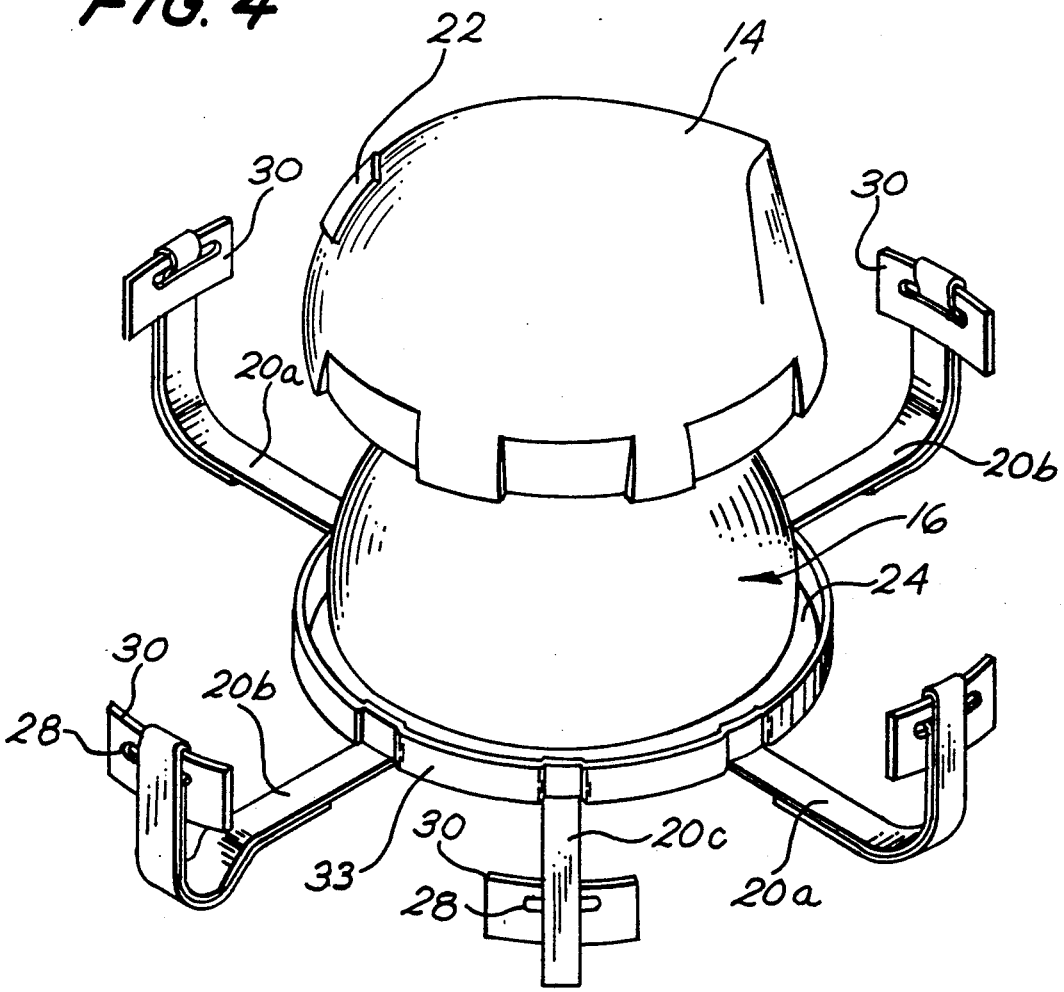
FIG. 4 shows an exploded perspective view of components parts within an outer shell of the helmet of FIG. 1, the outer shell and a headband assembly as shown if FIG. 1 being removed.

As seen best in FIGS. 1 and 3, an apex impact upon the outer shell 12 of the helmet 10 such as might be caused by a falling rafter or joist will tend to drive the outer shell 12, foam liner 14, and inner liner 16 downwardly in unison, thus increasing the tension in the straps 20*a, b* and *c* of the suspension system 18 on the head of the user. The anchors 30, being essentially incompressible, especially edgewise, and being supported on the floor of the channel 24 of rigid material, thus allow the straps 20*a, b* and *c* to stretch to take up all of the apex impact loading force applied to the outer shell 12. The straps 20*a, b* and *c* should be sufficiently resilient within the apex impact loading design limits of the helmet 10 to permit them to return to their normal, unstressed lengths following stretching occasioned by apex impact loading within such helmet design limits. Such apex impact loading of the outer shell 12 will not cause the anchors 30 to produce deformations in the foam liner 14 at the various anchor locations, at least within the design limits for which the helmet 10 is manufactured. Deformations of the foam liner 14, other than possibly at the point of impact itself, only occur as the result of lateral impact force components which occur at, or which are transferred to, a side of the shell 12 away from the apex thereof. Accordingly, at least within the design limits of the helmet 10, the non-resilient foam liner 14 will not suffer permanent deformation at the anchor locations as a result of apex impact loading on the outer shell 12.

Although the present invention has been described with respect to specific details of a certain preferred embodiment thereof, it is not intended that such details limit the scope thereof other than as specifically set forth in the following claims.

I claim:

1. protective helmet comprising:

an outer shell, a compressible, non-resilient foam liner disposed within and conforming to an interior surface of said outer shell, a rigid inner shell conforming to and disposed within said foam liner, said inner shell also including an annularly extending channel attached to an outer edge portion of said inner shell, an edge portion of said foam liner extending into said channel, a suspension system including a series of straps constructed of flexible, stretchable, resilient material, said straps crossing over one another at an apex on a medial centerline of said helmet under said inner shell, and a plurality of essentially rigid, non-resilient, incompressible anchor members, disposed upon a floor of said channel each of said members being disposed within an outwardly opening recess formed in an outer surface portion of said foam liner, each of said straps extending from said apex downwardly under and across said channel and upwardly between said outer shell and said foam liner and being secured on a distal end portion thereof to a different one of said anchors.

2. The helmet of claim 1 wherein said suspension system includes three straps connected on distal end portions thereof to six of said anchor members disposed in six of said recesses which are rotationally spaced from one another and formed in an outer surface portion of said liner.

3. The helmet of claim 1 wherein said anchor members are generally rectangular and slightly arc shaped to conform to an outer wall of said annularly extending channel.

4. The helmet of claim 3 wherein each of said anchor members contains an open slot therein through which one of said straps extends, said one strap extending upwardly over an upper edge of one of said anchor members and thence downwardly across an outer face of said one anchor member and along a portion of the length of the corresponding strap to a termination, the overlapping portions of each of said straps being secured together in a region near said termination.

5. The helmet of claim 1 wherein said foam liner is removably attached to said outer shell by means of at least one loop pile patch.

6. The helmet of claim 1 wherein said inner shell is constructed of polyphenylene oxide thermoplastic material.

7. The helmet of claim 1 wherein said anchor members are constructed of polyamide plastic.

8. The helmet of claim 1 wherein said straps are constructed of a material selected from the group consisting of woven aramid fiber and woven nylon fiber.

9. The helmet of claim 1 wherein said anchor members are removably disposed upon a floor of said channel.

10. The helmet of claim 1 wherein said anchor members each contain a slot through which a different distal end portion of said straps extends.

11. The helmet of claim 10 wherein said straps are secured to said anchor members by overlapping an end portion of the distal end of each of said straps, after it has been passed through a slot in an anchor member, with a portion of the corresponding straps being disposed inwardly of said channel, said end portion of said distal end being stitched to the corresponding overlapping strap portion.

12. The helmet of claim 1 wherein said anchor members are each removably disposed in said channel for aiding in installation, replacement and removal of said suspension system.

13. The helmet of claim 1 wherein said channel is integrally attached to said inner shell.

14. A protective helmet comprising:

an outer shell, a compressible foam liner disposed in said outer shell, a rigid inner shell disposed at least partially within said foam liner, an annularly extending channel attached to an outer edge portion of said inner shell, an edge portion of said liner being disposed within said channel, a suspension system including a series of flexible, stretchable, resilient straps, and incompressible, non-resilient means disposed in said channel between a surface of said foam liner and said outer shell for securing distal end portions of said straps thereto such that an apex impact loading force applied to said shell within design limits of said helmet is absorbed without producing deformation of said liner at the location of said strap securing means.

* * * * *